US009982925B2

(12) United States Patent
Lim et al.

(10) Patent No.: US 9,982,925 B2
(45) Date of Patent: May 29, 2018

(54) AIR CONDITIONER AND METHOD OF CONTROLLING AN AIR CONDITIONER

(71) Applicant: LG Electronics Inc., Seoul (KR)

(72) Inventors: Hongjae Lim, Seoul (KR); Jaewan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 503 days.

(21) Appl. No.: 14/571,578

(22) Filed: Dec. 16, 2014

(65) Prior Publication Data

US 2015/0168044 A1 Jun. 18, 2015

(30) Foreign Application Priority Data

Dec. 17, 2013 (KR) ..... 10-2013-0157619

(51) Int. Cl.
*F25B 5/00* (2006.01)
*F25B 41/00* (2006.01)
(Continued)

(52) U.S. Cl.
CPC ..... *F25B 41/003* (2013.01); *F24F 11/0012* (2013.01); *F25B 13/00* (2013.01); *F25B 40/02* (2013.01); *F25B 31/004* (2013.01); *F25B 43/02* (2013.01); *F25B 45/00* (2013.01); *F25B 2313/023* (2013.01); *F25B 2313/0253* (2013.01); *F25B 2313/0254* (2013.01); *F25B 2313/02741* (2013.01); *F25B 2313/0315* (2013.01); *F25B 2400/075* (2013.01);
(Continued)

(58) Field of Classification Search
CPC ..... F25B 13/00; F25B 41/003; F25B 31/004; F25B 43/02; F25B 45/00; F25B 2313/0253; F25B 2400/13; F25B 2400/16; F25B 2500/24; F25B 2600/2501; F25B 2600/2509
See application file for complete search history.

(56) References Cited

U.S. PATENT DOCUMENTS

2006/0032254 A1* 2/2006 Kim ..... F25B 13/00 62/197
2011/0154840 A1* 6/2011 Mihara ..... F25B 9/008 62/196.1
(Continued)

FOREIGN PATENT DOCUMENTS

EP 2 587 177 5/2013

OTHER PUBLICATIONS

European Search Report dated May 21, 2015.

*Primary Examiner* — Elizabeth Martin
(74) *Attorney, Agent, or Firm* — KED & Associates, LLP

(57) ABSTRACT

An air conditioner and a method of controlling an air conditioner are provided. The method of controlling an air conditioner may include determining whether a low-load condition is satisfied on the basis of a number of indoor devices or a temperature of external air, performing a low-load operation of a compressor at a predetermined frequency when the low-load condition is satisfied, detecting whether an operation pressure is out of a target pressure value or range while the low-load operation is performed, and bypassing a refrigerant from the compressor to a gas/liquid separator via an injection passage when the operation pressure is out of the target pressure value or range.

10 Claims, 5 Drawing Sheets

(51) Int. Cl.

| | |
|---|---|
| ***F25B 13/00*** | (2006.01) |
| ***F25B 40/02*** | (2006.01) |
| ***F24F 11/00*** | (2018.01) |
| *F25B 31/00* | (2006.01) |
| *F25B 43/02* | (2006.01) |
| *F25B 45/00* | (2006.01) |

(52) U.S. Cl.
CPC ..... *F25B 2400/13* (2013.01); *F25B 2400/16* (2013.01); *F25B 2400/23* (2013.01); *F25B 2500/24* (2013.01); *F25B 2500/29* (2013.01); *F25B 2600/0271* (2013.01); *F25B 2600/0272* (2013.01); *F25B 2600/2501* (2013.01); *F25B 2600/2509* (2013.01)

(56) References Cited

U.S. PATENT DOCUMENTS

| | | | | |
|---|---|---|---|---|
| 2012/0266622 | A1 | 10/2012 | Inaba et al. | |
| 2013/0104594 | A1* | 5/2013 | Lee | F24F 11/06 62/510 |
| 2014/0326002 | A1* | 11/2014 | Sunderland | F25B 49/027 62/56 |

* cited by examiner

AIR CONDITIONER AND METHOD OF CONTROLLING AN AIR CONDITIONER

CROSS-REFERENCE TO RELATED APPLICATION(S)

The present application claims priority under 35 U.S.C. 119 and 35 U.S.C. 365 to Korean Patent Application No. 10-2013-0157619, filed in Korea on Dec. 17, 2013, which is hereby incorporated by reference in its entirety.

BACKGROUND

1. Field

An air conditioner and a method of controlling an air conditioner are disclosed herein.

2. Background

Air conditioners are appliances that maintain air within a predetermined space in a most proper state according to a use and purpose thereof. In general, such an air conditioner may include a compressor, a condenser, an expansion device, and evaporator. Thus, the air conditioner has a refrigerant cycle in which compression, condensation, expansion, and evaporation processes of a refrigerant are performed. Thus, the air conditioner may heat or cool the predetermined space.

The predetermined space may be variously provided according to a place at which the air conditioner is used. For example, when the air conditioner is disposed in a home or office, the predetermined space may be an indoor space of a house or building. On the other hand, when the air conditioner is disposed in a vehicle, the predetermined space may be a space in which a person rides.

When the air conditioner performs a cooling operation, an outdoor heat-exchanger provided in an outdoor unit or device may serve as a condenser, and an indoor heat-exchanger provided in an indoor unit or device may serve as an evaporator. On the other hand, when the air conditioner performs a heating operation, the indoor heat-exchanger may serve as the condenser, and the outdoor heat-exchanger may serve as the evaporator.

In general, an air conditioner may include a compressor, a gas/liquid separator to separate a gaseous refrigerant to introduce the separated gaseous refrigerant into the compressor, a flow switching part or switch to switch a flow direction of the high-pressure refrigerant discharged from the compressor, and outdoor and indoor heat-exchangers. When the air conditioner performs a cooling operation, the refrigerant compressed in the compressor may be introduced into the outdoor heat-exchanger via the flow switching part. Then, the refrigerant condensed in the outdoor heat-exchanger may be decompressed in an expansion device and evaporated in the indoor heat-exchanger.

When the air conditioner performs a heating operation, the refrigerant compressed in the compressor may be introduced into the indoor heat-exchanger via the flow switching part. Then, the refrigerant condensed in the indoor heat-exchanger may be decompressed in an expansion device and evaporated in the outdoor heat-exchanger.

When the air conditioner performs the cooling or heating operation, the refrigerant compressed in the compressor may generally have a pressure (high pressure) within a predetermined range. However, the high pressure may rise to an abnormal range during operation. For example, if external air changes in temperature, or an amount of refrigerant circulating in the cycle is not suitable, the high pressure may rise.

Also, in a case of the heating operation, a time taken to allow the refrigerant discharged from the compressor to circulate according to a length of a tube may increase when a system initially operates. Thus, a pressure of a compressor suction inlet may be significantly lowered. Also, due to the above-described limitations, an oil forming phenomenon may occur within the compressor, or the compressor may operate out of an operable range thereof, deteriorating reliability.

To solve the above-described limitations, if the high pressure rises, the compressor according to the related art operates at a lowest frequency. In detail, the air conditioner according to the related art performs the cooling or heating operation, a target high-pressure or a target low-pressure of the compressor may be initially set, and an operation high-pressure or low-pressure of the operating compressor detected.

The detected operation high-pressure or operation low-pressure and the set target high-pressure or target low-pressure may be compared to each other to determine an operation state of the compressor. That is, it is determined whether the operation high-pressure detected by a high-pressure sensor is above the target high-pressure and whether the operation low-pressure detected by a low-pressure sensor is below the target low-pressure.

If it is determined that the detected operation high-pressure is below the target high-pressure, or the operation low-pressure is above the target low-pressure, the target high-pressure and the target low-pressure may be changed and reset. That is, when a difference between the operation high-pressure and the operation low-pressure is less than a difference between the target high-pressure and the target low-pressure, the target pressure may be reset so that an operation pressure corresponding to an indoor load is generated. On the other hand, when it is determined that the detected operation high-pressure is above the target high-pressure, or the operation low-pressure is below the target low-pressure, the compressor may be variably controlled to allow the operation low-pressure to reach the target low-pressure.

That is, according to the related art, the operation high-pressure or low-pressure of the air conditioner may be detected, and the detected operation high-pressure or operation low-pressure may be compared to the initially set target high-pressure or target low-pressure to change a target value so that a difference between the high-pressure and the low-pressure belongs to a predetermined range to prevent the difference between the operation pressure and the target pressure from being excessive, thereby allowing a protection operation for the compressor to be performed.

As a result, operation of the compressor may be controllable on the basis of operation frequency in the related art. More particularly, the compressor may operate at a lowest frequency during the low load operation to control an operation factor.

However, when the compressor operates at the lowest frequency, a lowest amount of refrigerant previously set in the system has to be maintained. Thus, the lowest frequency operation performance of the compressor may be high, and thus, operation efficiency may be deteriorated. That is, according to the related art, there is a limitation that it is difficult to efficiently control the operation of the air conditioner under the low load condition.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
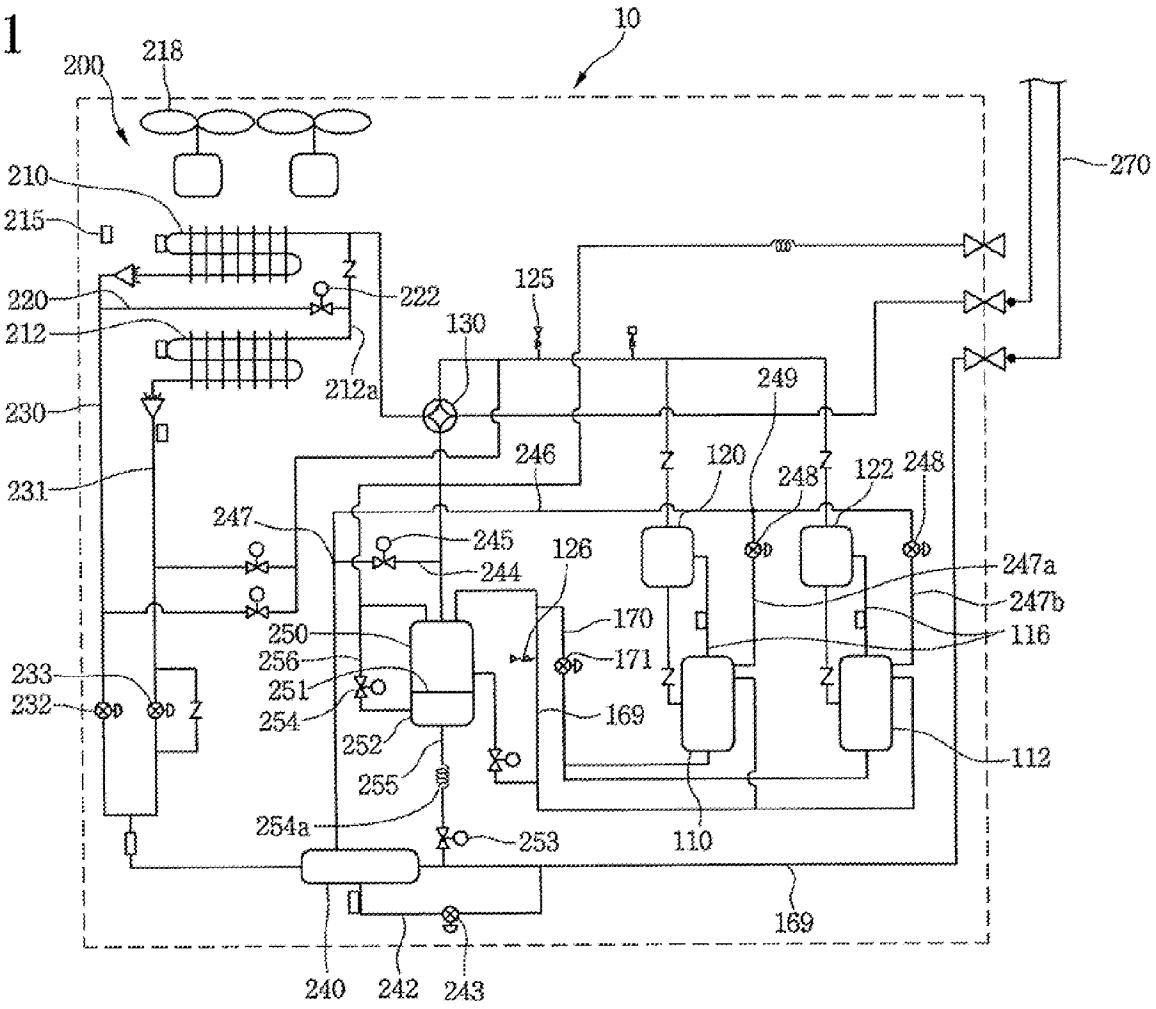
FIG. 1 is a schematic diagram of components of an air conditioner according to an embodiment.

FIG. 1 is a schematic diagram of an air conditioner according to an embodiment. Referring to FIG. 1, air conditioner 10 according to an embodiment may include a plurality of compressors 110 and 112. The plurality of compressors 110 and 112 may include a first compressor 110 and a second compressor 112, which may be connected in parallel to each other.

Oil separators 120 and 122 to separate oil from a discharged refrigerant may be disposed at outlet-sides of the plurality of compressors 110 and 112, respectively. The oil separators 120 and 122 may include a first oil separator 120 disposed at the outlet-side of the first compressor 110, and a second oil separator 122 disposed at the outlet-side of the second compressor 112.

The air conditioner 10 may further include a collection passage 116 to collect the separated oil into the first and second oil separators 120 and 122. The collection passage 116 may extend from the first oil separator 120 to the first compressor 110 and from the second oil separator 122 to the second compressor 112 to collect the oil into the first and second compressors 110 and 112.

A high-pressure sensor 125 to detect a discharge pressure of the refrigerant discharged from the compressors 110 and 112, and a flow switching part or flow switch 130 to guide the refrigerant passing through the high-pressure sensor 125 to an outdoor heat-exchanger 200 or an indoor unit or device may be disposed at outlet-sides of the oil separators 120 and 122. For example, the flow switching part 130 may include a four-way valve.

When the air conditioner 10 performs a cooling operation, the refrigerant may be introduced into the flow switching part 130. On the other hand, when the air conditioner 10 performs a heating operation, the refrigerant may flow from the flow switching part 130 into the indoor heat-exchanger 200 of the indoor unit or device.

The refrigerant passing through the outdoor heat-exchanger 200 may be introduced into a supercooling heat-exchanger 240. The supercooling heat-exchanger 240 may be understood as an intermediate heat-exchanger, in which a first refrigerant circulating into a system and a branched portion (a second refrigerant) of the first refrigerant may be heat-exchanged with each other. The first refrigerant may be supercooled while being heat-exchanged in the supercooling heat-exchanger 240, and the second refrigerant may be heated.

The air conditioner 10 may further include a supercooling passage 242 in which the second refrigerant is branched. A supercooling expansion device 243 to decompress the second refrigerant may be disposed in the supercooling passage 242. The supercooling expansion device 243 may include an electronic expansion valve (EEV).

The second refrigerant, which may be heat-exchanged in the supercooling heat-exchanger 240, may be introduced into the gas/liquid separator 250 or the first and second compressors 110 and 112. The gas/liquid separator 250 may be configured to separate a gaseous refrigerant from the refrigerant before the refrigerant is introduced into the compressors 110 and 112. The separated gaseous refrigerant may be introduced into the first and second compressors 110 and 112 along a main suction passage 169. Also, a low-pressure sensor 126 to detect a pressure of the suctioned refrigerant may be further provided in the main suction passage 169.

The air conditioner 10 may further include a uniform oil tube 170 that extends from the first and second compressors 110 and 112 to the main suction passage 169, and a uniform oil valve 171 disposed in the uniform oil tube 170. At least a portion of the oil stored in the first or second compressor 110 or 112 may flow into the uniform oil tube 170, and then, may be supplied into the main suction passage 169.

The air conditioner 10 may include a bypass passage 244 branched from the supercooling passage 242 to guide the refrigerant into the gas/liquid separator 250, and an injection passage 246 to guide the refrigerant into the first and second compressors 110 and 112. The air conditioner 10 may include a first branch 247 from which the bypass passage 244 and the injection passage 246 may be branched.

A bypass valve 245 to control a turn-on/off operation or an opening degree of the bypass passage 244 may be disposed in the bypass passage 244. For example, the bypass valve 245 may include a solenoid valve.

The injection passage 246 may include a first branch tube 247*a* and a second branch tube 247*b*. The first and second branch tubes 247*a* and 247*b* may be branched from the injection passage 246 to inject the refrigerant into the first and second compressors 110 and 112, respectively. The air conditioner 10 may further include a second branch 249, from which the first and second branch tubes 247*a* and 247*b* may be branched.

The air conditioner 10 may further include an injection valve 248 disposed in each of the first and second branch tubes 247*a* and 247*b*. The injection valve 248 may include an electric expansion valve (EEV), an opening degree of which is adjustable. An amount of refrigerant injected into each of the first and second compressors 110 and 112 may be adjusted by controlling the opening degree of the injection valve 248.

The air conditioner 10 may include a receiver 252 to store at least a portion of the first refrigerant passing through the supercooling heat-exchanger 240, and a receiver inlet passage 255 branched from an outlet-side of the supercooling heat-exchanger 240 to the receiver 252 to guide a flow of the first refrigerant. A receive inlet valve 253 to adjust an amount of refrigerant flowing into the receiver inlet passage 255, and a decompression unit or device 254*a* to decompress the refrigerant may be disposed in the receiver inlet passage 255. For example, the decompression unit 254*a* may include a capillary tube.

A receiver outlet tube 256 may be connected to the receiver 252. The receiver outlet tube 256 may extend from the receiver 252 to the gas/liquid separator 250. At least a portion of the refrigerant stored in the receiver 252 may be introduced into the gas/liquid separator 250 through the receiver outlet tube 256.

A receiver outlet valve 254 to adjust an amount of refrigerant discharged from the receiver 252 may be disposed in the receiver outlet tube 256. An amount of refrigerant injected into the gas/liquid separator 250 may be adjusted by controlling an opening degree of the receiver outlet valve 254.

The receiver 252 may be coupled to the gas/liquid separator 250. In detail, the receiver 252 and the gas/liquid separator 250 may be partitioned by a partition plate 251 within a refrigerant storage tank. For example, the gas/liquid separator 250 may be disposed in an upper portion of the refrigerant storage tank, and the receiver 252 may be disposed in a lower portion of the refrigerant storage tank.

A remaining refrigerant, except for the refrigerant flowing into the receiver inlet tube 255, of the first refrigerant passing through the supercooling heat-exchanger 240 may be introduced into the indoor unit through a connection tube 270. When the air conditioner 10 performs the heating operation, the indoor heat-exchanger disposed in the indoor unit may serve as a "condenser". On the other hand, when the air conditioner 10 performs the cooling operation, the outdoor heat-exchanger 200 may serve as a "condenser".

The outdoor heat-exchanger 200 may include a plurality of heat-exchange parts or heat exchangers 210 and 212, and one or more outdoor fan 218. The plurality of heat-exchange parts 210 and 212 may include a first heat-exchange part 210 and a second heat-exchange part 212, which may be connected in parallel to each other.

The outdoor heat-exchanger 200 may further include a variable passage 220 to guide a flow of the refrigerant from an outlet-side of the first heat-exchange part 210 to an inlet-side of the second heat-exchange part 212. The variable passage 220 may extend from a first outlet tube 230, that is, an outlet-side tube of the first heat-exchange part 210 to an inlet tube 212*a*, that is, an inlet-side tube of the second heat-exchange part 212.

A first valve 222 disposed in the variable passage 220 to adjust a flow of the refrigerant may be disposed in the outdoor heat-exchanger 200. For example, the first valve 222 may include an on/off-controllable valve. The refrigerant passing through the first heat-exchange part 210 may be selectively introduced into the second heat-exchange part 212 according to whether the first valve 222 is turned on or off.

In detail, when the first valve 222 is turned on or opened, the refrigerant passing through the first heat-exchange part 210 may flow into the inlet tube 212*a* via the variable passage 220, and then, may be heat-exchanged in the second heat-exchange part 212. Also, the refrigerant passing through the second heat-exchange part 212 may be introduced into the supercooling heat-exchanger 240 through a second outlet tube 231. On the other hand, when the first valve 222 is turned off, the refrigerant passing through the first heat-exchange part 210 may be introduced into the supercooling heat-exchanger 240 through the first outlet tube 230.

A second valve 232 to adjust a flow of the refrigerant may be disposed in the first outlet tube 230, and a third valve 233 to adjust a flow of the refrigerant may be disposed in the second outlet tube 231. The second valve 232 and the third valve 233 may be connected to each other in parallel. Also, the second or third valve 232 or 233 may include an EEV, an opening degree of which is adjustable.

When the second valve 232 is opened or increases in opening degree, an amount of refrigerant flowing through the first outlet tube 230 may increase. Also, when the third valve 233 is opened or increases in opening degree, an amount of refrigerant flowing through the second outlet tube 231 may increase. The first outlet tube 230 and the second outlet tube 231 may be combined with each other and be connected to the inlet-side tube of the supercooling heat-exchanger 240.

The outdoor heat-exchanger 200 may further include an outdoor temperature sensor 215 to detect a temperature of external air.

In this embodiment, if a required load is low, a low-load operation may be performed. Also, if an operation pressure is less than a preset or predetermined target pressure even when the low-load operation is performed, an operation factor may be controlled through bypassing of the refrigerant.

Hereinafter, a method of controlling an operation factor when the air conditioner operates at a low load will be described hereinbelow.

Figure 2:
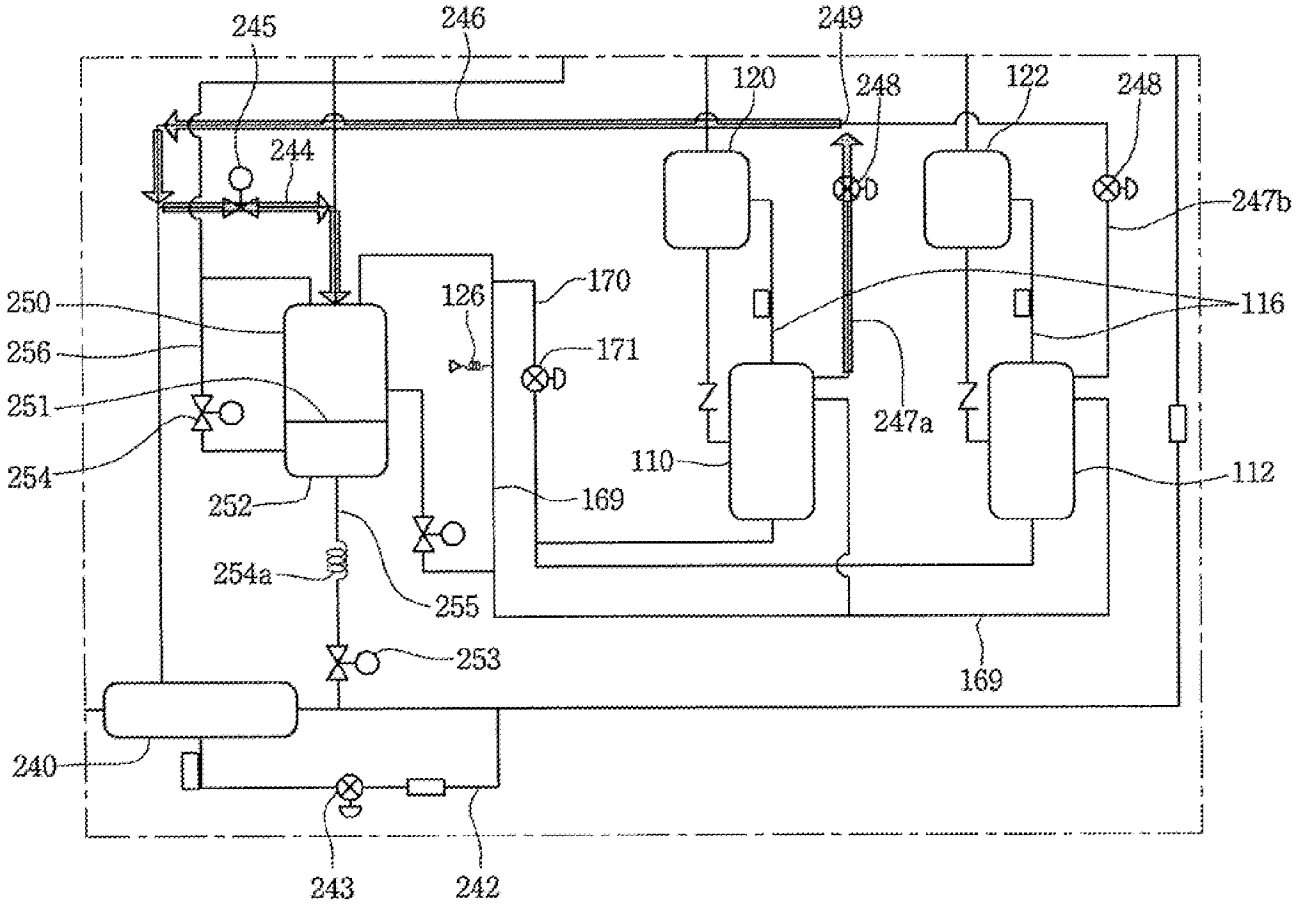
FIG. 2 is a cycle view illustrating a flow rate adjustment path of the air conditioner of FIG. 1.
Figure 3:
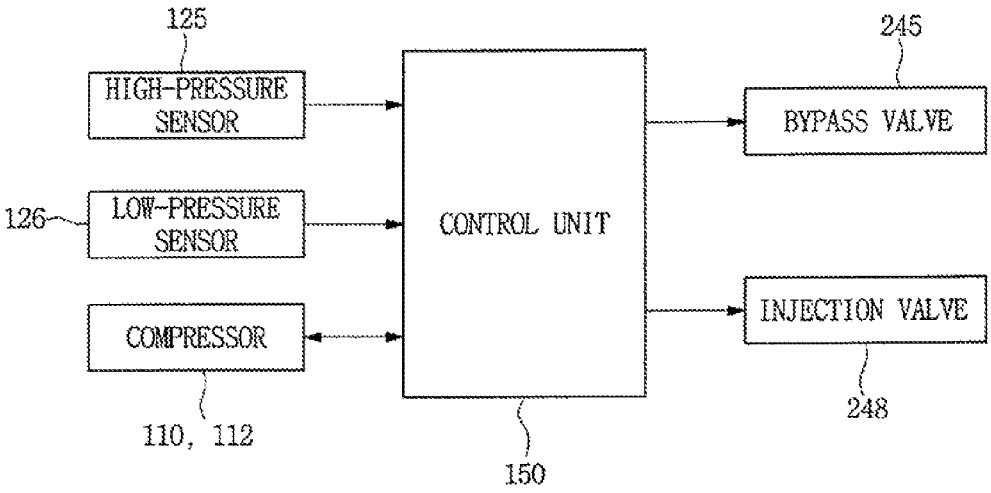
FIG. 3 is a block diagram of components for controlling a flow rate of the air conditioner of FIG. 1.
Figure 4:
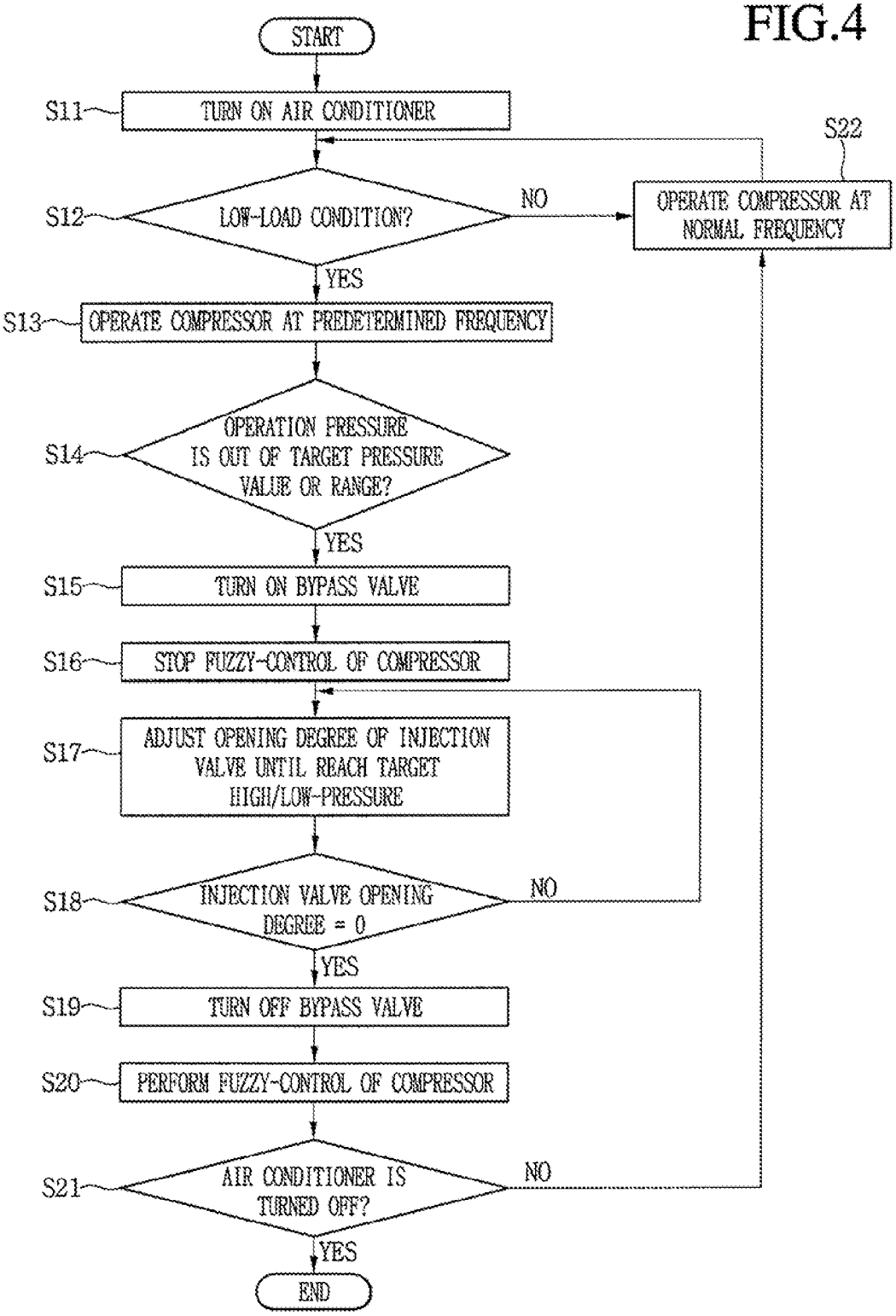
FIG. 4 is a flowchart of a method of controlling an air conditioner when the air conditioner operates at a low load according to an embodiment.
Figure 5:
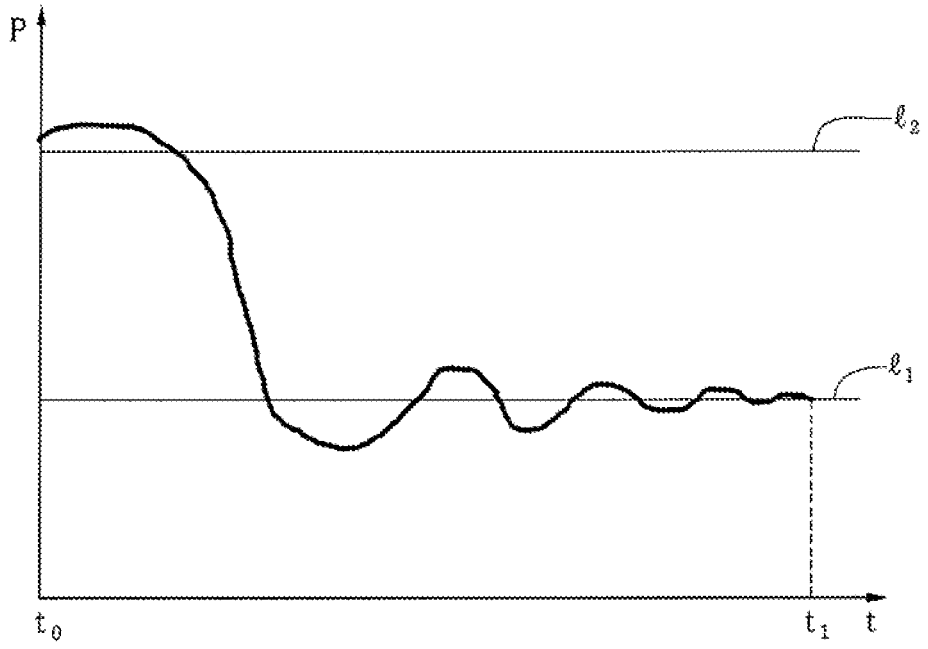
FIG. 5 is a graph illustrating operation efficiency when the air conditioner according to an embodiment operates at the low load.

FIG. 2 is a cycle view illustrating a flow rate adjustment path of the air conditioner of FIG. 1. FIG. 3 is a block diagram of components for controlling a flow rate of the air conditioner of FIG. 1. FIG. 4 is a flowchart of a method of controlling an air conditioner when the air conditioner operates at a low load according to an embodiment. FIG. 5 is a graph illustrating operation efficiency when the air conditioner according to an embodiment operates at the low load.

Referring to FIGS. 2 to 4, when an air conditioner is turned on, a required load is determined. For example, the required load may be determined on the basis of a number of operating indoor units or devices of a plurality of indoor units or devices, or a temperature of external air. In steps S11 to S13 of FIG. 4, the more the number of indoor units (an indoor unit load) decreases, and the temperature of the external air increases when a heating operation is performed, the more the required load may decrease.

If a load required for the indoor units is low, that is, when a low-load condition is satisfied, a low-load operation process, in step S13, in which each of first and second compressors 110 and 112 may operate at a preset or predetermined low frequency may be performed. In the low-load operation process, in step S13, each of the first and second compressors 110 and 112 may be fuzzy-controlled to a low frequency to control an operation factor of the compressor according to the low-load state. Also, the preset low frequency may be a "minimum frequency", for example, a frequency of about 15 Hz. On the other hand, if the low-load condition is not satisfied, each of the first and second compressors 110 and 112 may operate at a normal frequency, in step S22.

Although each of the first and second compressors 110 and 112 may operate at the low frequency through the low-load operation process, in step S14, if the operation pressure (a high-pressure or low-pressure) exceeds a preset or predetermined target pressure (a target high-pressure or target low-pressure) value or range, the operation high-pressure may increase above the target high-pressure, and the operation low-pressure may decrease below the target low-pressure.

For example, when the indoor load is relatively very low, and the temperature of the external air is relatively very high, even though each of the first and second compressors 110 and 112 may operate at the preset minimum frequency, it may be determined that operation performance of each of the first and second compressors 110 and 112 is significantly greater than the required load. Thus, when the operation pressure is out of the target pressure value or range, in step S14, a control unit or controller 150 may perform flow rate control processes, in steps S15 to S17, to bypass refrigerant from the compressors 110 and 112 to gas/liquid separator 250.

In detail, bypass valve 245 may be opened or turned on, in step S15, and a fuzzy control of each of the first and second compressors 110 and 112 may be stopped, in step S16. For example, the bypass valve 235 may be fully opened to secure a path through which the refrigerant may be bypassed from the first and second compressors 110 and 112 to the gas/liquid separator 250, in steps S15 and S16.

Also, an opening degree of the injection valve 248 may be adjusted to adjust an amount of refrigerant flowing into the bypass passage 244 from the first and second compressors 110 and 112 via first and second branch tubes 247*a* and 247*b* and injection passage 246, in step S17. When the bypass valve 245 and the injection valve 248 are opened, the refrigerant may flow from the first and second branch tubes 247*a* and 247*b* in which a relatively high-pressure may be generated, to the bypass passage 244, in which a relatively low-pressure may be generated. The bypassing of the refrigerant from the injection passage 246 to the bypass passage 244 may be performed by adjusting an opening degree of the injection valve 248, in a state in which the bypass valve 245 is opened, or may be performed by simultaneously controlling the opening of the bypass valve 245 and adjustment of the injection valve 248.

As described above, as the refrigerant may flow from the first and second compressors 110 and 112 to the gas/liquid separator 250 by successively passing through the first and second branch tubes 247*a* and 247*b*, the injection passage 246, and the bypass passage 244, an amount of refrigerant within the first and second compressors 110 and 112 may be reduced to control the operation factor of each of the first and second compressors 110 and 112 and reduce performance of each of the first and second compressors 110 and 112. While the operation factor of each of the first and second compressors 110 and 112 may be controlled, the operation pressure (the high-pressure and low-pressure) in a cycle may be variable. The control of the opening degree of the injection valve 248 may be performed until the operation pressure of the cycle reaches a target pressure. That is, the control of the opening degree of the injection valve 248 may be performed until the high-pressure of the operation pressure decreases to reach the target high-pressure, or the low-pressure of the operation pressure increases to reach the target low-pressure.

In detail, the opening degree of the injection valve 248 may be determined based on whether a first difference valve between the operation high-pressure detected by the high-pressure sensor 125 and the preset target high-pressure, or a second difference value between the operation low-pressure detected by the low-pressure sensor 126 and the preset target low-pressure reach a preset or predetermined value or range. For example, when the air conditioner 10 performs a heating operation, the control for comparing the first difference valve may be performed. On the other hand, when the air conditioner 10 performs a cooling operation, the control for comparing the second difference value may be performed.

The more the first or second difference valve increases, the more the opening degree of the injection valve 248 may be controlled to increase. When the first or second difference valve reaches the preset range, the injection valve 248 may be closed (where, the opening degree=0), in step S18.

In summary, the bypass flow of the refrigerant may be performed while the opening degree of the injection valve 248 is fuzzy-controlled on the basis of the pressure detected by the high-pressure sensor 125 or the low-pressure sensor 126. The bypass flow of the refrigerant may be performed until the operation pressure reaches the target pressure, in steps S17 and S18.

When the injection valve 248 is closed, that is, when the opening degree of the injection valve 248 is zero, the bypass valve 245 may be controlled to be closed, and the first and second compressors 110 and 112 may be fuzzy-controlled to the preset frequency. The above-described control may be performed until the air conditioner 10 is turned off, in steps S19, S20, and S21.

Referring to FIG. 5, reference symbol ℓ 1 is understood as a pressure value that represents a target pressure, and reference symbol ℓ 2 is understood as a pressure value that represents an operation pressure when each of the compressors 110 and 112 operates at a low load. Thus, a case in which the pressure value ℓ 2 is greater than the operation pressure ℓ 1 may represent a state in which the operation pressure of the cycle exceeds the target pressure, in step S14 of FIG. 4.

Thus, although the operation pressure significantly exceeds the target pressure at a time t0, while steps S16 to S18 of FIG. 4 are performed, the operation pressure may be converged to the target pressure at a time t1. As a result, when the air conditioner operates at the low load, the operation efficiency of the first and second compressors 110 and 112 according to the operation state may be improved.

According to embodiments, when the low load operation of the compressor is performed, if the operation pressure does not reach the target pressure (high-pressure/low-pressure), the bypass valve and the injection valve may be controlled to control the operation factor of the compressor. Therefore, unnecessary energy loss may be reduced, improving reliability of the product.

Embodiments disclosed herein provide a method of controlling an air conditioner capable of controlling an operation factor of a compressor even though an operation pressure exceeds a target pressure (high/low pressure) when the compressor operates at a lowest frequency during a low load operation.

Embodiments disclosed herein provide a method of controlling an air conditioner that may include determining whether a low-load condition is satisfied on the basis of a number of indoor units or devices or a temperature of external air; performing a low-load operation of a compressor at a preset or predetermined frequency when the low-load condition is satisfied; detecting whether a operation pressure is out of a target pressure value or range while the low-load operation is performed; and bypassing a refrigerant from the compressor to a gas/liquid separator via an injection passage when the operation pressure is out of the target pressure value or range.

The air conditioner may further include a bypass passage connected to the gas/liquid separator, and a first branch part or branch, from which the injection passage and the bypass passage may be branched. The bypassing of the refrigerant may include introducing the refrigerant into the gas/liquid separator by successively passing through the injection passage and the bypass passage.

The air conditioner may further include a bypass valve disposed in the bypass passage to adjust a flow rate of the refrigerant. The bypassing of the refrigerant may further include opening the bypass valve.

The air conditioner may further include an injection valve disposed in the injection passage to adjust a flow rate of the refrigerant. The bypassing of the refrigerant may include adjusting an opening degree of the injection valve.

The air conditioner may further include first and second branch tubes branched from a second branch part or branch of the injection passage. The first branch tube may extend to a first compressor, and the second branch tube may extend to a second compressor.

The air conditioner may further include a high-pressure sensor to detect a refrigerant discharge pressure of the compressor during the operation pressure, and a low-pressure sensor to detect a refrigerant suction pressure of the compressor during the operation pressure. The adjusting of the opening degree of the injection valve may be performed until the pressure detected by the high-pressure sensor or low-pressure sensor reaches the target pressure value or range.

The target pressure value or range may include a value or range with respect to a preset or predetermined target high-pressure, and when the air conditioner performs a heating operation, the adjusting of the opening degree of the injection valve may be performed until the pressure detected by the high-pressure sensor reaches the value or range with respect to the target high-pressure. The target pressure value or range may include a value or range with respect to a preset or predetermined target low-pressure, and when the air conditioner performs a cooling operation, the adjusting of the opening degree of the injection valve may be performed until the pressure detected by the low-pressure sensor reaches the value or range with respect to the target low-pressure.

When the pressure detected by the high-pressure sensor or the low-pressure sensor reaches the target pressure value or range, the bypass valve may be closed. When the operation pressure is out of the target pressure value or range, a fuzzy-control of the compressor may be stopped, and when the pressure detected by the high-pressure sensor or the low-pressure sensor reaches the target pressure value or range, a fuzzy-control of the compressor may be performed.

Embodiments disclosed herein an air conditioner that may include a compressor to compress a refrigerant; a gas/liquid separator disposed in or at a suction-side of the compressor to separate a gaseous refrigerant of the refrigerant, thereby supplying the separated gaseous refrigerant into the compressor; a condenser disposed in an outlet-side of the compressor to condense the refrigerant; a supercooler disposed on an outlet-side of the condenser; a first branch part disposed on or at an outlet-side of the supercooler; a bypass passage, in which a bypass valve may be disposed, the bypass passage extending from the first branch part to the gas/liquid separator; an injection passage, in which an injection valve may be disposed, the injection passage extending from the first branch part to the compressor; and a control unit or controller that opens the bypass valve and the injection valve to bypass the refrigerant from the compressor to the gas/liquid separator when a discharge pressure of the compressor is higher than a target high-pressure, or a suction pressure of the compressor is lower than a target low-pressure.

The bypass valve may include an on/off-controllable solenoid value, and the injection valve may include an electric expansion value, an opening degree of which is adjustable. The control unit may control the injection valve so that the injection valve is closed when the discharge pressure of the compressor reaches the target high-pressure, or the suction pressure of the compressor reaches the target low-pressure.

The compressor may include a first compressor and a second compressor, and first and second branch tubes, respectively, branched to the first and second compressors may be disposed in the injection passage. The control unit may set an operation frequency of the compressor to a preset or predetermined minimum frequency when a low-load condition is satisfied on the basis of the number of operating indoor units or a temperature of external air.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims, in addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling an air conditioner including a tank having a gas/liquid separator, a receiver, and a divider to separate the gas/liquid separator from the receiver; an outlet tube that extends from the receiver to the gas/liquid separator; having a bypass passage connected to the gas/liquid separator; a first branch from which an injection passage and the bypass passage are branched; a bypass valve provided in the bypass passage to adjust a flow rate of a refrigerant; an injection valve provided in the injection passage to adjust the flow rate of the refrigerant; a high-pressure sensor that detects a refrigerant discharge pressure of a compressor; and a low-pressure sensor that detects a refrigerant suction pressure of the compressor, the method comprising:

determining whether a low-load condition is satisfied based on a number of indoor devices or a temperature of external air;

firstly performing a low-load operation of the compressor at a predetermined frequency when the low-load condition is satisfied;

detecting whether an operation pressure is out of a target pressure range while the low-load operation is performed; and secondly bypassing the refrigerant from the compressor to the gas/liquid separator via the injection passage by opening both the bypass valve and the injection valve when the operation pressure is out of the target pressure range, wherein the low-load condition is satisfied when the number of indoor devices is less than a predetermined number or the temperature of external air is below a predetermined temperature, wherein the bypassing the refrigerant includes:

when the air conditioner performs a heating operation, changing an opening degree of the injection valve in a state in which the injection valve opens until a pressure detected by the high-pressure sensor is within a first target pressure range, and when the air conditioner performs a cooling operation, changing the opening degree of the injection valve in a state in which the injection valve opens until a pressure detected by the low-pressure sensor is within a second target pressure range.

2. The method according to claim 1, wherein the bypassing of the refrigerant includes introducing the refrigerant into the gas/liquid separator by successively passing the refrigerant through the injection passage and the bypass passage.

3. The method according to claim 1, wherein the air conditioner further includes first and second branch tubes branched from a second branch of the injection passage, and wherein the first branch tube extends to a first compressor, and the second branch tube extends to a second compressor.

4. The method according to claim 1, wherein, in the heating operation, when the pressure detected by the high-pressure sensor is within the first target pressure range, the bypass valve is closed.

5. The method according to claim 4, wherein, in the heating operation, when the operation pressure is out of the first target pressure range, a fuzzy-control of the compressor is stopped, and when the pressure detected by the high-pressure sensor is within the first target pressure range, a fuzzy-control of the compressor is performed.

6. The method according to claim 1, wherein, in the cooling operation, when the pressure detected by the low-pressure sensor is within the second target pressure range, the bypass valve is closed.

7. The method according to claim 6, wherein, in the cooling operation, when the operation pressure is out of the second target pressure range, a fuzzy-control of the compressor is stopped, and when the pressure detected by the high-pressure sensor is within the second target pressure range, a fuzzy-control of the compressor is performed.

8. The method according to claim 1, the air conditioner further includes:

a pipe that connects an outdoor heat exchanger to an indoor heat exchanger; and a super-cooling heat exchanger installed at the pipe.

9. The method according to claim 8, the air conditioner further includes:

an inlet tube that extends from the super-cooling heat exchanger towards the receiver.

10. The method according to claim 9, the air conditioner further includes:

a first valve installed at the inlet tube; and a second valve installed at the outlet tube.

* * * * *